United States Patent [19]

Kanamaru et al.

[11] Patent Number: 4,578,158

[45] Date of Patent: Mar. 25, 1986

[54] PROCESS FOR ELECTROPLATING A METALLIC MATERIAL WITH AN IRON-ZINC ALLOY

[75] Inventors: Tatsuya Kanamaru; Motohiro Nakayama; Yutaka Ogawa; Katutoshi A. Arai, all of Tokai, Japan

[73] Assignee: Nippon Steel Corporation, Tokyo, Japan

[21] Appl. No.: 666,464

[22] Filed: Oct. 30, 1984

[30] Foreign Application Priority Data

Nov. 1, 1983 [JP] Japan ..... 58-203720
Jan. 23, 1984 [JP] Japan ..... 59-8522

[51] Int. Cl.[4] ..... C25D 3/56
[52] U.S. Cl. ..... 204/44.2; 204/44.5
[58] Field of Search ..... 204/44.2, 44.5, 48, 204/55 R

[56] References Cited

U.S. PATENT DOCUMENTS

| | | | |
|---|---|---|---|
| 2,457,152 | 12/1948 | Hoffman | 204/54 |
| 2,832,729 | 4/1958 | Safranek | 204/44.5 |
| 4,070,256 | 1/1978 | Hsu et al. | 204/55 R |
| 4,384,930 | 5/1983 | Eckles | 204/55 R X |
| 4,444,629 | 4/1984 | Martin | 204/43 Z |

FOREIGN PATENT DOCUMENTS

| | | | |
|---|---|---|---|
| 602591 | 5/1948 | United Kingdom | 204/55 R |

*Primary Examiner*—G. L. Kaplan
*Attorney, Agent, or Firm*—Kenyon & Kenyon

[57] ABSTRACT

A metallic material is electroplated with an iron-zinc alloy with an improved efficiency by using an insoluble anode and an electroplating liquid containing, in addition to necessary amounts of zinc and ferrous ions, 0.01 to 10 g/l of an additive consisting of at least one member selected from oxyalkylene compounds of the formulae (I) to (VIII), $$H-O-(CH_2-CH_2-O)_n-H \quad (I)$$
$$R-O-(CH_2-CH_2-O)_{n1}-H \quad (II)$$

-continued (III)

(IV)

$$H-O-(CH(CH_3)-CH_2-O)_{n4}-H \quad (V)$$
$$R^3-O-(CH(CH_3)-CH_2-O)_{n5}-H \quad (VI)$$

(VII)

and (VIII)

wherein
n, $n^1$ or $n^5$=1 to 200,
$n^2$ or $n^6$=6 to 2000,
$n^3$ or $n^7$=4 to 2000,
$n^4$=2 to 2000,
R or $R^3$=alkyl ($C_1$–$C_{20}$)
$R^1$, $R^2$, $R^4$ or $R^5$=H or alkyl ($C_1$–$C_2$)

and sulfation products of the above-mentioned compounds.

2 Claims, 2 Drawing Figures

PROCESS FOR ELECTROPLATING A METALLIC MATERIAL WITH AN IRON-ZINC ALLOY

BACKGROUND OF THE INVENTION

1. Field of the Invention

The present invention relates to a process for electroplating a metallic material with an iron-zinc alloy. More particularly, the present invention relates to a process for electroplating a metallic material, for example, a steel strip, in an electroplating sulfate liquid containing iron ($Fe^{2+}$) and zinc ($Zn^{2+}$) ions to form an electroplated iron-zinc alloy layer having a desired composition while preventing undesirable oxidation of ferrous ions in the electroplating sulfate liquid.

2. Description of the Prior Art

In usual electroplating procedures, it is known that a chemically noble metal deposits preferentially to a chemically base metal. This phenomenon is called normal type deposition. However, in an iron-zinc alloy electroplating procedure in which iron and zinc are contained mainly in the form of sulfates thereof in an electroplating liquid, zinc, which is a chemically base metal, deposits preferentially to iron, which is a chemically noble metal. This phenomenon is referred to as anomalous type deposition. Especially, where the electroplating liquid is contaminated with impurity ions, for example, Sn and Sb ions, the anomalous type deposition is promoted.

Due to the above-mentioned anomalous type deposition, and in order to obtain an electroplated iron-zinc alloy layer having a desired composition, it is necessary to make the molar ratio of zinc ions ($Zn^{2+}$) to the sum of zinc ions and ferrous ions ($Zn^{2+}+Fe^{2+}$) in the electroplating liquid significantly small in comparison with the molar ratio of zinc to the sum of zinc and iron in the resultant iron-zinc alloy having a desired composition. In this electroplating procedure, a fluctuation in the composition of the electroplating liquid, even if it is small, results in a large fluctuation in the composition of the resultant iron-zinc alloy. This phenomenon causes the control of the electroplating procedure to become difficult.

Accordingly, it has been strongly desired to provide a new iron-zinc alloy electroplating process in which the molar ratio of zinc ions to the sum of zinc and iron in the electroplating liquid is the same as or very close to that in the resultant electroplated iron-zinc alloy. In other words, it is desired to provide a new iron-zinc alloy electroplating liquid in which iron and zinc can deposit in a manner similar to or very close to the normal type deposition.

For example, Japanese Unexamined Patent Publication (Kokai) No. 57-192284 (1982) discloses an improved process for electroplating a steel strip with an iron-zinc alloy. In this process, an electroplating liquid containing 5 to 50 g/l of a polybasic carboxylic acid and 10 to 100 g/l of sodium acetate in addition to predetermined amounts of iron sulfate and zinc sulfate, is used.

It is known that when the iron-zinc alloy electroplating liquid is recycled in the electroplating procedure, an amount of air is introduced into the electroplating liquid. The introduced air serves to oxidize ferrous ions ($Fe^{2+}$) in the electroplating liquid. Otherwise, when an insoluble anode is used, ferrous ions ($Fe^{2+}$) are oxidized with oxygen generated on the anode or by a direct electrode reaction with the anode so as to produce ferric ions ($Fe^{3+}$). The above-mentioned oxidation phenomenon results in an undesirable increase in concentration of ferric ions ($Fe^{3+}$) in the electroplating liquid. The increased concentration of ferric ions ($Fe^{3+}$) lowers the efficiency of the electroplating procedure and results in an unsatisfactory quality of the resultant electroplated alloy layer.

Accordingly, it has been strongly desired to provide a new iron-zinc alloy electroplating liquid in which the air oxidation and anodic oxidation of ferrous ions are strictly restricted. In the electroplating process, ferrous ions ($Fe^{2+}$) and zinc ions ($Zn^{2+}$) in the electroplating liquid are consumed and additional ferrous ions and zinc ions are fed from metallic iron and zinc which are capable of reducing the ferric ions. Accordingly, it is strongly desired to provide an electroplating liquid in which the reduction of ferric ions can be effected at a high efficiency.

SUMMARY OF THE INVENTION

An object of the present invention is to provide a process for electroplating a metallic material with an iron-zinc alloy, in which process zinc and iron can be regularly deposited at similar depositing rates.

Another object of the present invention is to provide a process for electroplating a metallic material with an iron-zinc alloy, in which process undesirable oxidation of ferrous ions ($Fe^{2+}$) into ferric ions ($Fe^{3+}$) is strictly restricted.

A further object of the present invention is to provide a process for electroplating a metallic material with an iron-zinc alloy, in which process the concentration of undesirable ferric ions ($Fe^{3+}$) can be controlled.

The above-mentioned objects can be attained by the process of the present invention for electroplating a metallic material with an iron-zinc alloy, which process comprises electroplating a metallic material in an electroplating sulfate liquid containing iron and zinc ions and 0.01 to 10 g/l of an additive consisting of at least one member selected from the group consisting of oxyalkylene compounds of the formulae (I) to (VIII):

$$H-O-(CH_2-CH_2-O)_n-H \quad (I)$$

wherein n represents an integer of 1 to 2000, $$R-O-(CH_2-CH_2-O)_{n1}-H \quad (II)$$

wherein R represents an alkyl radical having 1 to 20 carbon atoms and $n^1$ represents an integer of 1 to 2000, (III)

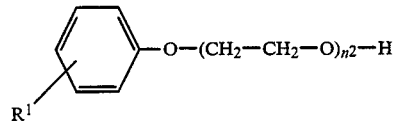

wherein $R^1$ represents a member selected from the group consisting of a hydrogen atom and alkyl radicals having 1 to 20 carbon atoms and $n^2$ represents an integer of 6 to 2000,

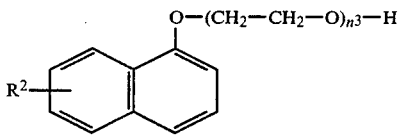

(IV)

wherein $R^2$ represents a member selected from the group consisting of a hydrogen atom and alkyl radicals having 1 to 20 carbon atoms and $n^3$ represents an integer of 4 to 2000,

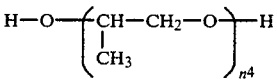

(V)

wherein $n^4$ represents an integer of 3 to 2000,

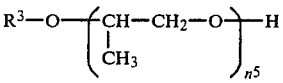

(VI)

wherein $R^3$ represents an alkyl radical having 1 to 20 carbon atoms and $n^5$ represents an integer of 1 to 2000,

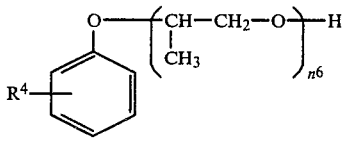

(VII)

wherein $R^4$ represents a member selected from a group consisting of a hydrogen atom and alkyl radicals having 1 to 20 carbon atoms and $n^6$ represent an integer of 6 to 2000, and

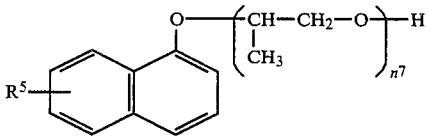

(VIII)

wherein $R_5$ represents a member selected from the group consisting of a hydrogen atom and alkyl radical having 1 to 20 carbon atoms and $n^7$ represents an integer of 4 to 2000, and sulfation products of the above-mentioned oxyalkylene compounds.

DESCRIPTION OF THE PREFERRED EMBODIMENTS

Figure 1:
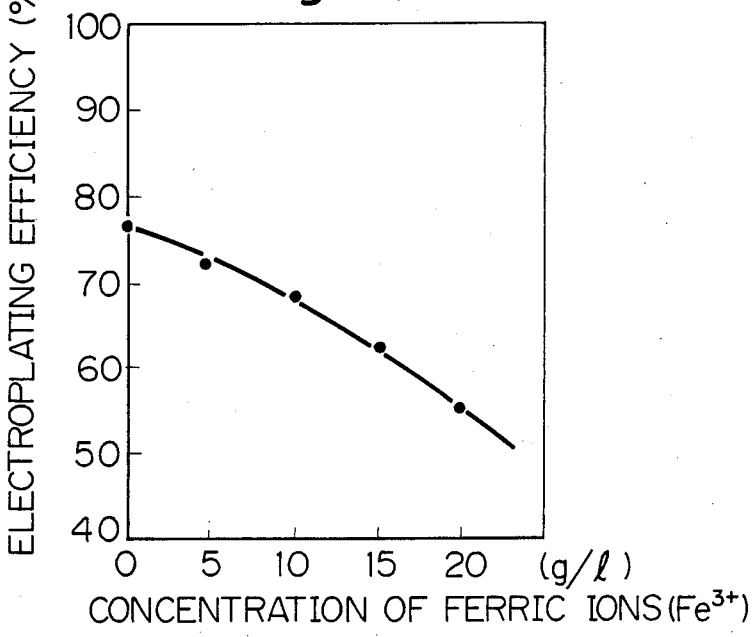
FIG. 1 is a diagram showing a relationship between the concentration of ferric ions ($Fe^{3+}$) in an iron-zinc alloy electroplating liquid and the electroplating efficiency of the resultant electroplated iron-zinc alloy layer.

In the process of the present invention for electroplating a metallic material, for example, a steel strip or steel sheet, with an iron-zinc alloy, an electroplating sulfate liquid containing iron ions and zinc ions and a specific additive is used. The specific additive consists of at least one member selected from the group consisting of oxyalkylene (alkylene glycol) compounds of the formulae (I) to (VIII);

(Poly)oxyethylene ((poly)ethylene glycol)

$H-O-(CH_2-CH_2-O)_n-H$ (I)

Alkyl(poly)oxyethylene ether $R-O-(CH_2-CH_2-O)_{n1}-H$ (II)

(Alkyl)phenyl-polyoxyethylene ether

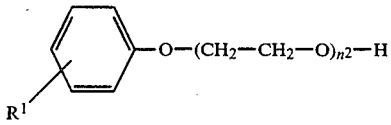

(III)

(Alkyl)naphthyl-polyoxyethylene ether

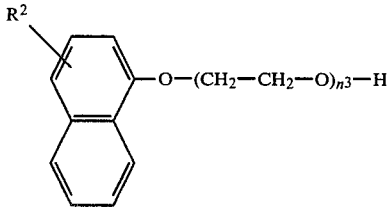

(IV)

Polyoxypropylene(polypropylene glycol)

$H-O-(CH(CH_3)-CH_2-O)_{n4}-H$ (V)

Alkyl(poly)oxypropylene ether $R^3-O-(CH(CH_3)-CH_2-O)_{n5}-H$ (VI)

(Alkyl)phenylpolyoxypropylene ether

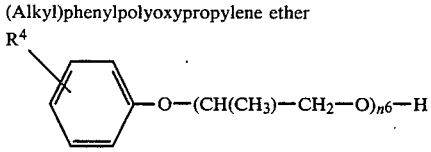

(VII)

and (Alkyl)naphthylpolyoxypropylene ether

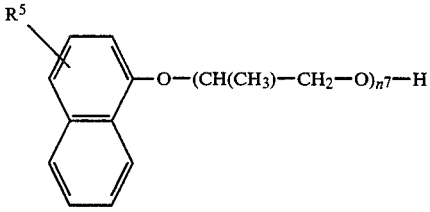

(VIII)

wherein n, $n^1$, and $n^5$, respectively, independently represent an integer of 1 to 2000, R and $R^3$, respectively, independently represent an alkyl radical having 1 to 20 carbon atoms, $R^1$, $R^2$, $R^4$, and $R^5$, respectively, independently represent a member selected from the group consisting of a hydrogen atom and alkyl radicals having 1 to 20 carbon atoms, $n^2$ and $n^6$, respectively, independently represent an integer of 6 to 2000, $n^3$ and $n^7$, respectively, independently represent an integer of 4 to 2000, and $n^4$ represents an integer of 3 to 2000, and sulfation products of the above-mentioned oxyalkylene compounds.

The specific additive of the present invention is preferably used in an amount of from 0.01 to 10 g/l. When the amount of the additive is less than 0.01 g/l, the objects of the present invention are not satisfactorily attained. If the specific additive is used in an amount larger than 10 g/l, the resultant electroplating process is costly due to loss (drag out) or consumption of the specific additive, which is expensive, and since the electroplating process discharges a waste liquid containing a large amount of the specific additive, which is an organic material, a specific equipment having a large capacity becomes necessary to clarify the waste liquid, and this clarifying process is costly.

The zinc ions and iron ions are contained in the form of sulfates of zinc and iron in the electroplating liquid. The concentrations of zinc sulfate and iron sulfate (ferrous sulfate) are not limited to specific values, respectively.

In the process of the present invention, the electroplating procedure is carried out in such a manner that a metallic material to be electroplated, which serves as a cathode, is immersed in an electroplating liquid and an electric current is applied in a desired current density, for example, 60 to 200 A/dm$^2$, between the metallic material and an anode at a temperature of, for example, 40° to 70° C. The anode may be an insoluble anode made of, for example, a Pb–Sn (5%) alloy.

In the process of the present invention, the addition of the specific additive exhibits the following effects.

(1) In spite of the fact that in the iron-zinc alloy electroplating procedure in which zinc and iron are used mainly in the form of sulfates thereof, and that zinc, which is a chemically base metal, tends to deposit preferentially to iron, which is a chemically noble metal, the use of the specific additive of the present invention causes iron to deposit preferentially to zinc in a manner similar to or very close to the normal type deposition manner. Therefore, the molar ratio of zinc to the sum of zinc and iron in the resultant electroplated iron-zinc alloy becomes close to the molar ratio of zinc ions ($Zn^{2+}$) to the sum of zinc ions and ferrous ions ($Fe^{2+}$) in the electroplating liquid. Due to this effect of the specific additive of the present invention, the range of the molar ratio of zinc ions to the sum of iron (ferrous) ions and zinc ions in the electroplating liquid capable of producing an electroplated iron-zinc alloy having a desired composition thereof becomes broad.

(2) Since the deposition of zinc and iron in the electroplating procedure of the present invention is carried out in a manner very close to the normal type deposition, the influence of a small amount of impurities, Sn and Sb, which promote the anomalous type deposition of iron and zinc, on the normal type deposition of iron and zinc is significantly decreased by the specific additive of the present invention.

(3) The specific additive of the present invention is effective to decrease the concentration of ferrous ions ($Fe^{2+}$) necessary for obtaining an electroplated iron-zinc alloy having a desired composition. Therefore, the generating rate of undesirable ferric ions ($Fe^{3+}$), which has an adverse influence on the electroplating procedure, can be restricted. The ferric ions ($Fe^{3+}$) are formed mainly by oxidation of ferrous ions ($Fe^{2+}$) on an insoluble anode. This oxidation rate depends on the diffusion of ferrous ions. That is, the generating rate of ferric ions is proportional to the concentration of ferrous ions in the electroplating liquid, i.e., the smaller the concentration of ferrous ions, the smaller the generation of ferric ions.

(4) The specific additive of the present invention is effective for promoting the reduction of ferric ions ($Fe^{3+}$) in the step of feeding ferrous ions and zinc ions into the electroplating liquid.

When ferric ions and zinc ions in the electroplating liquid are consumed, additional ferric and zinc ions are fed from metallic iron and zinc into the electroplating liquid. The metallic iron and zinc are also effective for the reduction of ferric ions. However, when the metallic iron and zinc is dissolved into the electroplating liquid, a hydrogen generating and dissolving reaction and a ferric ion reducing and dissolving reaction occur as competitive reactions. Therefore, it is desirable to restrict the hydrogen generating and dissolving reaction and to selectively promote the ferric ion reducing and dissolving reaction.

The specific additive of the present invention is effective for strictly restricting the hydrogen generating and dissolving reaction without restricting the ferric ion reducing and dissolving reaction.

(5) The specific additive of the present invention is effective for restricting the oxidation of ferrous ions ($Fe^{2+}$) into ferric ions ($Fe^{3+}$). The ferrous ions in the electroplating liquid are oxidized by air-oxidation and anodic oxidation. That is, when the electroplating liquid is encycled or stirred, the ferrous ions are brought into contact with air and are oxidized. Also, when an insoluble anode on which pure oxygen is generated upon applying an electric current, is used, the ferrous ions are oxidized by the pure oxygen. The specific additive of the present invention is effective for restricting the direct contact of the ferrous ions with air or oxygen.

(6) Since the iron-zinc alloy electroplating procedure of the present invention can be effectively carried out at a relatively large molar ratio of zinc ions ($Zn^{2+}$) to the sum of zinc ions and ferrous ions ($Zn^{2+}+Fe^{2+}$), that is, at a relatively small concentration of ferrous ions ($Fe^{2+}$), the direct oxidation of ferrous ions into ferric ions when an insoluble anode is used can be effectively restricted. The rate of the direct oxidation depends on the concentration of the ferrous ions in the electroplating liquid.

That is, the specific additive of the present invention is effective for restricting the direct oxidation of the ferrous ions into the ferric ions and for promoting the reduction of the ferric ions into the ferrous ions, and therefore, is effective for significantly decreasing the concentration of the ferric ions ($Fe^{3+}$) in the electroplating liquid.

As stated above, the smaller the concentration of ferric ions ($Fe^{3+}$) in the electroplating liquid, the higher the electroplating efficiency. This feature is clearly shown in FIG. 1.

FIG. 1 shows a relationship between the concentration of ferric ions and the electroplating efficiency when an electroplating procedure is carried out using an electroplating liquid containing 65 g/l of ferrous ions ($Fe^{2+}$), 35 g/l of zinc ions ($Zn^{2+}$), 0, 5, 10, 15, or 20 g/l of ferric ions ($Fe^{3+}$) and 10 g/l of free sulfuric acid, and having a temperature of 60° C., at a current density of 100 A/dm$^2$.

In view of FIG. 1, it is clear that an increase in the concentration of ferric ions in the electroplating liquid causes the electroplating efficiency to decrease.

Due to the above-mentioned effects of the specific additive, the process of the present invention exhibits the following advantages.

(1) An electroplated iron-zinc alloy having a desired composition thereof can be easily produced with an enhanced efficiency and the resultant electroplated product exhibits a satifactory quality.

(2) Even if the electroplating liquid contains undesirable impurities, Sn and Sb, the fluctuation in the composition of the resultant electroplated iron-zinc alloy is significantly restricted.

(3) Due to the remarkable restriction of air oxidation and anodic oxidation of ferrous ions, the concentration of ferric ions can be maintained at a very low level, and the efficiency of the electroplating process and the productivity of the electroplated product are remarkably improved.

(4) When the concentration of the ferric ions in the electroplating liquid is high, an addition of ammonium, potassium or sodium ions causes a deposition of basic ferric sulfate to be promoted by the ferric ions. Therefore, the addition of the ammonium, potassium or sodium ions to the electroplating liquid containing the ferric ions at a high concentration thereof results in a problem. However, when the concentration of the ferric ions is maintained at a very low level, the undesirable formation of floating solid flocks consisting of basic ferric sulfate from ferric ions significantly decreases. Therefore, the addition of $(NH_4)_2SO_4$, $NaSO_4$, or $K_2SO_4$, which are effective for enhancing the electric conductivity of the electroplating liquid, becomes allowable. The addition of the above-mentioned sulfates is effective for reducing the consumption of electric power and the cost of the electroplating procedure.

(5) A desired composition of electroplated iron-zinc alloy can be obtained at a relatively large molar ratio of $Zn^{2+}/Fe^{2+}+Zn^{2+}$. This phenomenon is effective for enhancing the electric current efficiency in the electroplating procedure.

(6) Since the electroplating procedure can be carried out at a high concentration of zinc ions, which exhibits a higher solubility in water than that of the ferrous ions, it is possible to make the sum of the concentrations of ferrous ions ($Fe^{2+}$) and zinc ions ($Zn^{2+}$) high. This high concentration of ions is effective for enhancing the electric current efficiency in the electroplating procedure, because the high concentration of the sum of the ferrous ions and zinc ions causes the concentration of hydrogen ions ($H^+$) in the electroplating liquid to relatively decrease, and results in a decrease in the generation of hydrogen gas ($H_2$) on the cathode and in an increase in the electroplating efficiency.

The specific examples presented below will serve to more fully explain how the present invention is practiced. However, it will be understood that these examples are only illustrative and in no way limit the scope of the present invention.

EXAMPLES 1 to 22 and Comparative Examples 1 to 6

In each of Examples 1 to 22 and in the Comparative Examples, a steel strip was electroplated with an electroplated iron-zinc alloy, consisting of 85% by weight ±3% by weight of zinc and the balance of iron, using an electroplating liquid having the composition indicated in Table 1 and containing 100 g/l of the sum of ferric ions ($Fe^{2+}$) and zinc ions ($Zn^{2+}$), at a temperature of 60° C. and at a current density of 100 A/dm$^2$.

The results are shown in Table 1. In Table 1, the ion-feeding and reducing efficiency of metallic zinc or metallic iron was determined in accordance with the following equation.

$$\text{Ion-feeding and reducing efficiency (\%)} = \frac{\text{(Amount consumed for ferric ion-reducing and dissolving reaction)}}{\left(\begin{array}{c}\text{Amount consumed for}\\ \text{hydrogen-generating}\\ \text{and dissolving}\\ \text{reaction}\end{array}\right) + \left(\begin{array}{c}\text{Amount consumed for}\\ \text{ferric ion-reducing}\\ \text{and dissolving}\\ \text{reaction}\end{array}\right)} \times 100$$

The amount (g/l) of ferric ions ($Fe^{3+}$) generated in the electroplating liquid was determined by measuring the increase in the amount of ferric ions when an electroplating procedure was carried out with a quantity of electricity of 10,000 c/l at a current density of 100 A/dm$^2$ by using an insoluble anode consisting of a Pb-Sn (5%) alloy.

Figure 2:
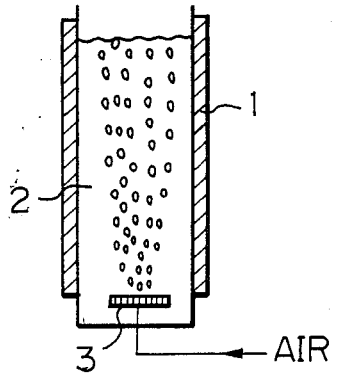
FIG. 2 is an explanatory cross-sectional view of an apparatus for determining a rate of oxidation of ferrous ions ($Fe^{2+}$) with air into ferric ions ($Fe^{3+}$).

The air oxidation rate of ferrous ions was determined by using an experiment equipment indicated in FIG. 2. Referring to FIG. 2, a vertical vessel 1 having an open top end and a length of 100 m was charged with an electroplating liquid 2 containing 65 g/l of ferrous ions ($Fe^{2+}$), 35 g/l of zinc ions ($Zn^{2+}$), 15 g/l of ferric ions ($Fe^{3+}$), and 10 g/l of free sulfuric acid; air (containing 20% by volume of oxygen) was blown into the vertical container 1 through a bubble-forming nozzle 3 at a flow rate of 1 m$^3$/min. The increase in the amount of ferric ions was measured.

EXAMPLES 23 to 34 and Comparative Examples 7 to 10

In each of Examples 23 to 34 and comparative Examples 7 to 10, the same procedures as those described in Example 1 were carried out except that the composition of the electroplating liquid was as indicated in Table 2 and the resultant electroplated alloy layer consisted of 70±3% by weight of zinc and the balance of iron.

The results are shown in Table 2.

Examples 35 to 46 and Comparative Examples 11 to 14

In each of Examples 35 to 46 and Comparative Examples 11 to 14, the same procedures as those described in Example 1 were carried out except that the composition of the electroplating liquid was as indicated in Table 3 and the resultant electroplated alloy layer consisted of 40±3% by weight of zinc and the balance of iron.

The results are shown in Table 3.

Examples 47 to 58 and Comparative Examples 15 to 18

In each of Examples 47 to 58 and Comparative Examples 15 to 18, the same procedures as those described in Example 1 were carried out except that the composition of the electroplating liquid was as indicated in Table 4 and the resultant electroplated alloy layer consisted of 20±3% by weight by zinc and the balance of iron.

The results are shown in Table 4.

Examples 59 to 63 and Comparative Examples 19 to 21

In each of Examples 59 to 63 and Comparative Examples 19 to 21, the same procedures as those described in Example 1 were carried out except that the composition of the electroplating liquid was as indicated in Table 5 and the resultant electroplated alloy layer consisted of the amount of zinc indicated in Table 5 and the balance of iron.

The results are shown in Table 5.

TABLE 1

| Example No. | Item: Composition of electroplating liquid: $Zn^{2+}/(Fe^{2+}+Zn^{2+})$ | $Fe^{3+}$ | Free $H_2SO_4$ | Inorganic additive | Impurities in electroplating liquid: Sn (ppm) | Sb (ppm) | Organic additive (g/l) | |
|---|---|---|---|---|---|---|---|---|
| 1 | 65% | 5 g/l | 10 g/l | 0 | 0 | 0 | Polyoxyethylene (n = 3 to 5) | 0.01 |
| 2 | 65 | 5 | 10 | 0 | 2 | 1 | Polyoxyethylene (n = 3 to 5) | 10 |
| 3 | 65 | 5 | 10 | 0 | 1 | 1 | Polyoxyethylene (n = 1800 to 2000) | 0.01 |
| 4 | 65 | 5 | 10 | 0 | 0 | 2 | Polyoxyethylene (n = 1800 to 2000) | 8 |
| 5 | 65 | 5 | 10 | 0 | 1 | 0 | Propylpolyoxyethylene ether (n = 10 to 15) | 0.01 |
| 6 | 65 | 5 | 10 | 0 | 2 | 2 | Propylpolyoxyethylene ether (n = 10 to 15) | 9 |
| 7 | 65 | 5 | 10 | 0 | 0 | 1 | Propylpolyoxyethylene ether (n = 1500 to 1800) | 0.01 |
| 8 | 65 | 5 | 10 | 0 | 1 | 2 | Propylpolyoxyethylene ether (n = 1500 to 1800) | 10 |
| 9 | 65 | 5 | 10 | 0 | 1 | 1 | Sulfation product of phenylpolyoxyethylene ether (n = 6 to 10) | 0.02 |
| 10 | 65 | 5 | 10 | 0 | 1 | 1 | Sulfation product of phenylpolyoxyethylene ether (n = 6 to 10) | 5 |
| 11 | 65 | 5 | 10 | 0 | 1 | 1 | Phenylpolyoxyethylene ether (n = 6 to 10) | 0.01 |
| 12 | 65 | 5 | 10 | 0 | 1 | 1 | Phenylpolyoxyethylene ether (n = 6 to 10) | 10 |
| 13 | 65 | 5 | 10 | 0 | 1 | 1 | Polyoxypropylene (n = 30 to 40) | 0.01 |
| 14 | 65 | 5 | 10 | 0 | 1 | 1 | Polyoxypropylene (n = 30 to 40) | 10 |
| 15 | 65% | 5 g/l | 10 g/l | 0 | 1 | 1 | Naphthylpolyoxyetylene ether (n = 6 to 10) | 0.01 |
| 16 | 65 | 5 | 10 | 0 | 1 | 1 | Naphthylpolyoxyethylene ether (n = 6 to 10) | 10 |
| 17 | 65 | 5 | 10 | 0 | 0 | 0 | Sulfation product of naphthylpolyoxylethylene ether (n = 6 to 10) | 0.05 |
| | | | | | | | Naphthylpolyoxyethylene ether (n = 6 to 10) | 0.05 |
| 18 | 65 | 5 | 10 | 0 | 1 | 1 | Sulfation product of naphthylpolyoxyethylene ether (n = 6 to 10) | 0.05 |
| | | | | | | | Polyoxyethylene (n = 20 to 25) | 0.1 |
| 19 | 65 | 5 | 10 | 0 | 1 | 1 | Propylpolyoxyethylene ether (n = 20 to 25) | 0.1 |
| | | | | | | | Polyoxyethylene (n = 20 to 25) | 1 |
| 20 | 65 | 5 | 10 | 0 | 1 | 1 | Propylphenylpolyoxy-ethylene ether (n = 8 to 12) | 0.01 |
| | | | | | | | Polyoxyethylene (n = 20 to 25) | 10 |
| 21 | 65% | 5 g/l | 10 g/l | 0 | 1 | 1 | Sulfation product of phenylpolyoxyethylene ether (n = 8 to 12) | 0.1 |
| | | | | | | | Phenylpolyoxyethylene ether (n = 8 to 12) | 0.1 |
| | | | | | | | Polyoxyethylene (n = 20 to 25) | 0.1 |
| | | | | | | | Polyoxyethylene (n = 20 to 25) | 10 |
| 22 | 65 | 5 | 10 | 0 | 1 | 1 | Polyoxypropylene (n = 20 to 25) | 0.1 |
| | | | | | | | Polyoxyethylene (n = 20 to 25) | 1 |
| | | | | | | | Sulfation product of phenylpolyoxyethylene ether (n = 8 to 12) | 0.1 |
| Comparative | | | | | | | | |

TABLE 1-continued

| Example No. | | | | | | | |
|---|---|---|---|---|---|---|---|
| 1 | 65% | 5 g/l | 10 g/l | 0 g/l | 0 | 0 | None |
| 2 | 65 | 10 | 10 | 0 | 1 | 1 | " |
| 3 | 35 | 5 | 10 | 0 | 1 | 1 | " |
| 4 | 40 | 10 | 10 | $MgSO_4.7H_2O$ 100 g/l | 1 | 1 | " |
| 5 | 40 | 5 | 10 | $Li_2SO_4$ 100 | 1 | 1 | " |
| 6 | 40 | 10 | 10 | $(NH_4)_2SO_4$ 30 | 1 | 1 | " |

| | Item | | | | |
|---|---|---|---|---|---|
| | | Ion-feeding and reducing efficiency | | | |
| Example No. | Amount of zinc in electroplated alloy (%) | Metallic Zn | Metallic Fe | Amount of $Fe^{3+}$ ions generated by applying electric current (g/c) | Air-oxidation rate (kg/Hr) |
| 1 | 86 | 85 | 90 | $1.2 \times 10^{-4}$ | 11.8 |
| 2 | 85 | 94 | 95 | $0.9 \times 10^{-4}$ | 11.2 |
| 3 | 86 | 88 | 90 | $1.1 \times 10^{-4}$ | 11.2 |
| 4 | 85 | 95 | 95 | $0.9 \times 10^{-4}$ | 11.1 |
| 5 | 86 | 80 | 90 | $1.0 \times 10^{-4}$ | 11.2 |
| 6 | 84 | 88 | 95 | $0.9 \times 10^{-4}$ | 11.0 |
| 7 | 86 | 85 | 90 | $1.2 \times 10^{-4}$ | 11.2 |
| 8 | 84 | 90 | 95 | $0.9 \times 10^{-4}$ | 11.1 |
| 9 | 86 | 84 | 88 | $1.1 \times 10^{-4}$ | 11.2 |
| 10 | 84 | 90 | 93 | $0.9 \times 10^{-4}$ | 11.2 |
| 11 | 86 | 84 | 87 | $1.1 \times 10^{-4}$ | 11.2 |
| 12 | 84 | 88 | 94 | $0.9 \times 10^{-4}$ | 11.2 |
| 13 | 85 | 85 | 88 | $1.1 \times 10^{-4}$ | 11.2 |
| 14 | 84 | 90 | 95 | $0.9 \times 10^{-4}$ | 11.2 |
| 15 | 85 | 85 | 90 | $1.1 \times 10^{-4}$ | 11.2 |
| 16 | 84 | 88 | 93 | $0.9 \times 10^{-4}$ | 11.0 |
| 17 | 84 | 85 | 90 | $1.1 \times 10^{-4}$ | 11.2 |
| 18 | 85 | 88 | 93 | $1.1 \times 10^{-4}$ | 11.2 |
| 19 | 84 | 90 | 94 | $1.0 \times 10^{-4}$ | 11.2 |
| 20 | 85 | 91 | 95 | $0.9 \times 10^{-4}$ | 11.2 |
| 21 | 85 | 92 | 95 | $0.9 \times 10^{-4}$ | 11.2 |
| 22 | 85 | 88 | 92 | $1.0 \times 10^{-4}$ | 11.2 |
| Comparative Example No. | | | | | |
| 1 | 97 | 45 | 70 | $1.6 \times 10^{-4}$ | 18.7 |
| 2 | 99 | 45 | 70 | $1.4 \times 10^{-4}$ | 18.7 |
| 3 | 85 | 45 | 70 | $1.4 \times 10^{-4}$ | 26.7 |
| 4 | 85 | 45 | 70 | $2.0 \times 10^{-4}$ | 23.3 |
| 5 | 85 | 45 | 70 | $2.0 \times 10^{-4}$ | 23.3 |
| 6 | 85 | 47 | 72 | $2.1 \times 10^{-4}$ | 23.3 |

TABLE 2

| | Item | | | | | | | |
|---|---|---|---|---|---|---|---|---|
| | Composition of electroplating liquid | | | | Impurities in electroplating liquid | | | |
| Example No. | $Zn^{2+}/(Fe^{2+} + Zn^{2+})$ | $Fe^{3+}$ | Free $H_2SO_4$ | Inorganic additive | Sn (ppm) | Sb (ppm) | Organic additive (g/l) | |
| 23 | 46% | 5 g/l | 10 g/l | 0 | 0 | 0 | Sulfation product of naphthylpolyoxyethylene ether (n = 6 to 10) | 0.01 |
| 24 | 46 | 5 | 10 | 0 | 1 | 1 | Sulfation product of naphthylpolyoxyethylene ether (n = 6 to 10) | 1 |
| 25 | 46 | 5 | 10 | 0 | 1 | 1 | Polyoxyethylene (n = 20 to 25) | 0.1 |
| 26 | 46 | 5 | 10 | 0 | 1 | 1 | Polyoxyethylene (n = 20 to 25) | 10 |
| 27 | 46 | 5 | 10 | 0 | 1 | 1 | Propylphenylpolyoxy-ethylene ether (n = 8 to 12) | 0.1 |
| 28 | 46 | 5 | 10 | 0 | 1 | 1 | Sulfation product of phenylpolyoxyethylene ether (n = 8 to 12) | 1 |
| 29 | 46 | 5 | 10 | 0 | 1 | 1 | Propylpolyoxyethylene ether (n = 20 to 25) | 0.01 |
| 30 | 46 | 5 | 10 | 0 | 1 | 1 | Polyoxypropylene (n = 20 to 25) | 10 |
| 31 | 46 | 5 | 10 | 0 | 1 | 1 | Propylphenylpolyoxy- | 1 |

TABLE 2-continued

| | | | | | | | | |
|---|---|---|---|---|---|---|---|---|
| | | | | | | | propylene ether (n = 8 to 12) | |
| 32 | 46 | 5 | 10 | 0 | 1 | 1 | Polyoxypropylene (n = 20 to 25) | 1 |
| 33 | 46 | 5 | 10 | 0 | 1 | 1 | Propylnaphthylpolyoxy-propylene ether (n = 8 to 12) | 0.01 |
| 34 | 46 | 5 | 10 | 0 | 1 | 1 | Sulfation product of naphthylpolyoxypropylene ether (n = 6 to 10) | 0.1 |
| Comparative Example 7 | 25% | 5 g/l | 10 g/l | 0 g/l | 0 | 0 | None | |
| Comparative Example 8 | 25 | 5 | 10 | 0 | 1 | 1 | None | |
| Comparative Example 9 | 30 | 5 | 10 | $MgSO_4.7H_2O$ 100 g/l | 1 | 1 | None | |
| Comparative Example 10 | 46 | 5 | 10 | 0 | 1 | 1 | None | |

| | Item | | | | |
|---|---|---|---|---|---|
| | | Ion-feeding and reducing efficiency | | | |
| Example No. | Amount of zinc in electroplated alloy (%) | Metallic Zn | Metallic Fe | Amount of $Fe^{3+}$ ions generated by applying electric current (g/c) | Air-oxidation rate (kg/Hr) |
| 23 | 70 | 87 | 93 | $1.8 \times 10^{-4}$ | 15.2 |
| 24 | 70 | 90 | 95 | $1.8 \times 10^{-4}$ | 15.1 |
| 25 | 70 | 89 | 95 | $1.7 \times 10^{-4}$ | 15.3 |
| 26 | 70 | 90 | 95 | $1.8 \times 10^{-4}$ | 15.0 |
| 27 | 70 | 89 | 95 | $1.8 \times 10^{-4}$ | 15.3 |
| 28 | 70 | 90 | 95 | $1.7 \times 10^{-4}$ | 15.1 |
| 29 | 70 | 88 | 92 | $1.8 \times 10^{-4}$ | 15.3 |
| 30 | 70 | 90 | 95 | $1.8 \times 10^{-4}$ | 15.0 |
| 31 | 70 | 90 | 95 | $1.8 \times 10^{-4}$ | 15.1 |
| 32 | 70 | 90 | 95 | $1.8 \times 10^{-4}$ | 15.1 |
| 33 | 70 | 88 | 95 | $1.8 \times 10^{-4}$ | 15.3 |
| 34 | 70 | 90 | 95 | $1.8 \times 10^{-4}$ | 15.2 |
| Comparative Example 7 | 70 | 45 | 70 | $3.8 \times 10^{-4}$ | 29.3 |
| Comparative Example 8 | 78 | 43 | 70 | $3.8 \times 10^{-4}$ | 29.3 |
| Comparative Example 9 | 71 | 44 | 70 | $3.2 \times 10^{-4}$ | 27.1 |
| Comparative Example 10 | 92 | 45 | 70 | $2.5 \times 10^{-4}$ | 20.4 |

TABLE 3

| | Item | | | | | | | |
|---|---|---|---|---|---|---|---|---|
| | Composition of electroplating liquid | | | | Impurities in electroplating liquid | | | |
| Example No. | $Zn^{2+}$ / $Fe^{2+} + Zn^{2+}$ | $Fe^{3+}$ | Free $H_2SO_4$ | Inorganic additive | Sn (ppm) | Sb (ppm) | Organic additive (g/l) | |
| 35 | 28% | 5 g/l | 10 g/l | 0 g/l | 0 | 0 | Sulfation product of naphthylpolyoxyethylene ether (n = 6 to 10) | 0.01 |
| 36 | 28 | 5 | 10 | 0 | 1 | 1 | Sulfation product of naphthylpolyoxyethylene ether (n = 6 to 10) | 1 |
| 37 | 28 | 5 | 10 | 0 | 1 | 1 | Polyoxyethylene (n = 20 to 25) | 0.1 |
| 38 | 28 | 5 | 10 | 0 | 1 | 1 | Polyoxyethylene (n = 20 to 25) | 10 |
| 39 | 28 | 5 | 10 | 0 | 1 | 1 | Propylphenylpolyoxy-ethylene ether (n = 8 to 12) | 0.1 |
| 40 | 28 | 5 | 10 | 0 | 1 | 1 | Sulfation product of phenylpolyoxyethylene ether (n = 8 to 12) | 1 |

TABLE 3-continued

| | | | | | | | | |
|---|---|---|---|---|---|---|---|---|
| 41 | 28 | 5 | 10 | 0 | 1 | 1 | Propylpolyoxyethylene ether (n = 20 to 25) | 0.01 |
| 42 | 28 | 5 | 10 | 0 | 1 | 1 | Polyoxypropylene (n = 20 to 25) | 10 |
| 43 | 28 | 5 | 10 | 0 | 1 | 1 | Propylphenylpolyoxy-propylene ether (n = 8 to 12) | 1 |
| 44 | 28 | 5 | 10 | 0 | 1 | 1 | Polyoxypropylene (n = 20 to 25) | 1 |
| 45 | 28 | 5 | 10 | 0 | 1 | 1 | Propylnaphthylpolyoxy-propylene ether (n = 8 to 12) | 0.01 |
| 46 | 28 | 5 | 10 | 0 | 1 | 1 | Sulfation product of naphthylpolyoxypropylene ether (n = 6 to 10) | 0.1 |
| Comparative Example 11 | 15% | 5 g/l | 10 g/l | 0 g/l | 0 | 0 | None | |
| Comparative Example 12 | 15 | 5 | 10 | 0 | 1 | 1 | None | |
| Comparative Example 13 | 17 | 5 | 10 | $MgSO_47H_2O$ 100 g/l | 1 | 1 | None | |
| Comparative Example 14 | 28 | 5 | 10 | 0 | 1 | 1 | None | |

| | Item | | | | |
|---|---|---|---|---|---|
| | | Ion-feeding and reducing efficiency | | | |
| Example No. | Amount of zinc in electroplated alloy (%) | Metallic Zn | Metallic Fe | Amount of $Fe^{3+}$ ions generated by applying electric current (g/c) | Air-oxidation rate (kg/Hr) |
| 35 | 40 | 87 | 93 | $2.5 \times 10^{-4}$ | 20.4 |
| 36 | 40 | 90 | 95 | $2.5 \times 10^{-4}$ | 20.4 |
| 37 | 40 | 89 | 95 | $2.5 \times 10^{-4}$ | 20.4 |
| 38 | 40 | 90 | 95 | $2.5 \times 10^{-4}$ | 20.4 |
| 39 | 40 | 89 | 95 | $2.5 \times 10^{-4}$ | 20.4 |
| 40 | 40 | 90 | 95 | $2.5 \times 10^{-4}$ | 20.4 |
| 41 | 40 | 88 | 92 | $2.5 \times 10^{-4}$ | 20.4 |
| 42 | 40 | 90 | 95 | $2.5 \times 10^{-4}$ | 20.4 |
| 43 | 40 | 90 | 95 | $2.5 \times 10^{-4}$ | 20.4 |
| 44 | 40 | 90 | 95 | $2.5 \times 10^{-4}$ | 20.4 |
| 45 | 40 | 88 | 95 | $2.5 \times 10^{-4}$ | 20.4 |
| 46 | 40 | 90 | 95 | $2.5 \times 10^{-4}$ | 20.4 |
| Comparative Example 11 | 40 | 45 | 70 | $3.9 \times 10^{-4}$ | 34.1 |
| Comparative Example 12 | 48 | 43 | 70 | $3.9 \times 10^{-4}$ | 34.1 |
| Comparative Example 13 | 40 | 44 | 70 | $3.7 \times 10^{-4}$ | 32.1 |
| Comparative Example 14 | 68 | 45 | 70 | $3.4 \times 10^{-4}$ | 28.6 |

TABLE 4

| | Item | | | | | | | |
|---|---|---|---|---|---|---|---|---|
| | Composition of electroplating liquid | | | | Impurities in electroplating liquid | | | |
| Example No. | $Zn^{2+}$ / $Fe^{2+} + Zn^{2+}$ | $Fe^{3+}$ | Free $H_2SO_4$ | Inorganic additive | Sn (ppm) | Sb (ppm) | Organic additive (g/l) | |
| 47 | 15% | 5 g/l | 10 g/l | 0 g/l | 0 | 0 | Sulfation product of naphthylpolyoxyethylene ether (n = 6 to 10) | 0.01 |
| 48 | 15 | 5 | 10 | 0 | 1 | 1 | Sulfation product of naphthylpolyoxyethylene ether (n = 6 to 10) | 1 |
| 49 | 15 | 5 | 10 | 0 | 1 | 1 | Polyoxyethylene (n = 20 to 25) | 0.1 |
| 50 | 15 | 5 | 10 | 0 | 1 | 1 | Polyoxyethylene (n = 20 to 25) | 10 |
| 51 | 15 | 5 | 10 | 0 | 1 | 1 | Propylphenylpolyoxy-ethylene ether | 0.1 |

TABLE 4-continued

| | | | | | | | | |
|---|---|---|---|---|---|---|---|---|
| | | | | | | | (n = 8 to 12) | |
| 52 | 15 | 5 | 10 | 0 | 1 | 1 | Sulfation product of phenylpolyoxyethylene ether (n = 8 to 12) | 1 |
| 53 | 15 | 5 | 10 | 0 | 1 | 1 | Propylpolyoxyethylene ether (n = 20 to 25) | 0.01 |
| 54 | 15 | 5 | 10 | 0 | 1 | 1 | Polyoxypropylene (n = 20 to 25) | 10 |
| 55 | 15 | 5 | 10 | 0 | 1 | 1 | Propylphenylpolyoxy-propylene ether (n = 8 to 10) | 1 |
| 56 | 15 | 5 | 10 | 0 | 1 | 1 | Propylpolyoxypropylene (n = 20 to 25) | 1 |
| 57 | 15 | 5 | 10 | 0 | 1 | 1 | Propylnaphthylpolyoxy-propylene ether (n = 8 to 12) | 0.01 |
| 58 | 15 | 5 | 10 | 0 | 1 | 1 | Sulfation product of naphthylpolyoxypropylene ether (n = 6 to 10) | 0.1 |
| Comparative Example 15 | 6% | 5 g/l | 10 g/l | 0 g/l | 0 | 0 | None | |
| Comparative Example 16 | 6 | 5 | 10 | 0 | 1 | 1 | None | |
| Comparative Example 17 | 8 | 5 | 10 | $MgSO_4.7H_2O$ 100 g/l | 1 | 1 | None | |
| Comparative Example 18 | 15 | 5 | 10 | 0 | 1 | 1 | None | |

| | Item | | | | |
|---|---|---|---|---|---|
| | | Ion-feeding and reducing efficiency | | | |
| Example No. | Amount of zinc in electroplated alloy (%) | Metallic Zn | Metallic Fe | Amount of $Fe^{3+}$ ions generated by applying electric current (g/c) | Air-oxidation rate (kg/Hr) |
| 47 | 20 | 87 | 93 | $3.2 \times 10^{-4}$ | 26.3 |
| 48 | 20 | 89 | 95 | $3.2 \times 10^{-4}$ | 26.4 |
| 49 | 20 | 88 | 94 | $3.2 \times 10^{-4}$ | 26.4 |
| 50 | 20 | 89 | 95 | $3.2 \times 10^{-4}$ | 26.4 |
| 51 | 20 | 88 | 94 | $3.2 \times 10^{-4}$ | 26.4 |
| 52 | 20 | 90 | 95 | $3.2 \times 10^{-4}$ | 26.4 |
| 53 | 20 | 87 | 93 | $3.2 \times 10^{-4}$ | 26.4 |
| 54 | 20 | 90 | 95 | $3.2 \times 10^{-4}$ | 26.4 |
| 55 | 20 | 90 | 95 | $3.2 \times 10^{-4}$ | 26.4 |
| 56 | 20 | 90 | 95 | $3.2 \times 10^{-4}$ | 26.4 |
| 57 | 20 | 87 | 92 | $3.2 \times 10^{-4}$ | 26.4 |
| 58 | 20 | 88 | 93 | $3.2 \times 10^{-4}$ | 26.4 |
| Comparative Example 15 | 20 | 45 | 70 | $4.6 \times 10^{-4}$ | 37.2 |
| Comparative Example 16 | 28 | 44 | 70 | $4.6 \times 10^{-4}$ | 37.2 |
| Comparative Example 17 | 20 | 44 | 70 | $4.2 \times 10^{-4}$ | 35.7 |
| Comparative Example 18 | 48 | 43 | 70 | $3.9 \times 10^{-4}$ | 34.1 |

TABLE 5

| | Item | | | | | | |
|---|---|---|---|---|---|---|---|
| | Composition of electroplating liquid | | | | Impurities in electroplating liquid | | |
| Example No. | $Zn^{2+}$ / $Fe^{2+} + Zn^{2+}$ | $Fe^{3+}$ | Free $H_2SO_4$ | Inorganic additive | Sn (ppm) | Sb (ppm) | Organic additive (g/l) |
| 59 | 65% | 5 g/l | 10 g/l | 0 g/l | 0 | 0 | ENSA 0.01 |
| 60 | 65 | 5 | 10 | 0 | 2 | 1 | ENSA 2 |
| 61 | 65 | 5 | 10 | $MgSO_4.7H_2O$ 50 g/l | 1 | 3 | EN 0.01 |
| 62 | 65 | 5 | 10 | 0 | 0 | 0 | EN 2 |
| 63 | 65 | 5 | 10 | 0 | 1 | 1 | ENSA 0.01<br>EN 0.01 |

TABLE 5-continued

| | | | | | | | |
|---|---|---|---|---|---|---|---|
| Comparative Example 19 | 65 | 5 | 10 | 0 | 0 | 0 | None |
| Comparative Example 20 | 65 | 5 | 10 | 0 | 1 | 1 | " |
| Comparative Example 21 | 35 | 5 | 10 | 0 | 2 | 0 | " |

| | Item | | | | |
|---|---|---|---|---|---|
| | Amount of zinc in electroplated | Ion-feeding and reducing efficiency | | Amount of $Fe^{3+}$ ions generated by applying electric | Air-oxidation |
| Example No. | alloy (%) | Metallic Zn | Metallic Fe | current (g/c) | rate (kg/Hr) |
| 59 | 85 | 85 | 90 | $1.2 \times 10^{-4}$ | 11.8 |
| 60 | 83 | 90 | 93 | $0.9 \times 10^{-4}$ | 11.2 |
| 61 | 85 | 84 | 88 | $1.0 \times 10^{-4}$ | 11.2 |
| 62 | 82 | 90 | 93 | $0.9 \times 10^{-4}$ | 11.2 |
| 63 | 83 | 84 | 88 | $1.1 \times 10^{-4}$ | 11.2 |
| Comparative Example 19 | 97 | 45 | 70 | $1.6 \times 10^{-4}$ | 18.7 |
| Comparative Example 20 | 99 | 45 | 70 | $1.4 \times 10^{-4}$ | 18.7 |
| Comparative Example 21 | 85 | 45 | 70 | $1.4 \times 10^{-4}$ | 18.7 |

Note:
ENSA — Sulfation product of naphylpolyoxyethylene ether
EN — Naphthylpolyoxyethylene ether Tables 1 to 5 clearly show that the specific additive of the present invention is highly effective for stably carrying out the electroplating procedure at high ion-feeding and reducing efficiencies of the metallic zinc and iron while restricting the increase in the concentration of ferric ions ($Fe^{3+}$) and decreasing the air oxidation rate of ferrous ions ($Fe^{2+}$).

We claim:

1. A process for electroplating a metallic material with an iron-zinc alloy, comprising electroplating a metallic material, by using an insoluble anode, in an electroplating sulfate liquid containing iron and zinc ions and 0.01 to 10 g/l of an additive consisting of at least one member selected from the group consisting of oxyalkylene compounds of the formulae (I) to (VIII):

$$H-O-(CH_2-CH_2-O)_n-H \quad (I)$$

wherein n represents an integer of 1 to 2000, $$R-O-(CH_2-CH_2-O)_{n1}-H \quad (II)$$

wherein R represents an alkyl radical having 1 to 20 carbon atoms and $n^1$ represents an integer of 1 to 2000,

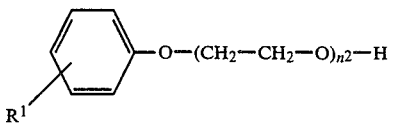

(III)

wherein $R^1$ represents a member selected from the group consisting of a hydrogen atom and alkyl radicals having 1 to 20 carbon atoms and $n^2$ represents an integer of 6 to 2000,

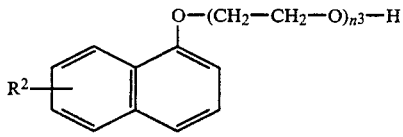

(IV)

wherein $R^2$ represents a member selected from the group consisting of a hydrogen atom and alkyl radicals having 1 to 20 carbon atoms and $n^3$ represents an integer of 4 to 2000,

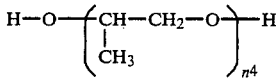

(V)

wherein $n^4$ represents an integer of 3 to 2000,

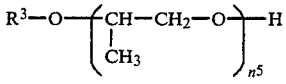

(VI)

wherein $R^3$ represents an alkyl radical having 1 to 20 carbon atoms and $n^5$ represents an integer of 1 to 2000,

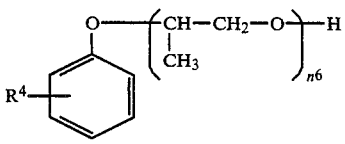

(VII)

wherein $R^4$ represents a member selected from a group consisting of a hydrogen atom and alkyl radicals having 1 to 20 carbon atoms and $n^6$ represent an integer of 6 to 2000, and

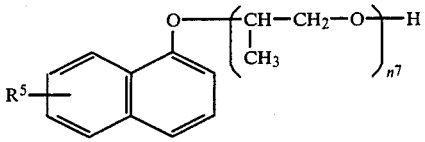

(VIII)

whereim $R_5$ represents a member selected from the group consisting of a hydrogen atom and alkyl radical having 1 to 20 carbon atoms and $n^7$ represents an integer of 4 to 2000, and sulfation products of the above-mentioned oxyalkylene compounds.

2. The process as claimed in claim 1, wherein said additive consists of at least one member selected from the group consisting of the naphthylpolyoxyethylene ethers of the formula (IV) and the sulfation products thereof.

* * * * *

UNITED STATES PATENT AND TRADEMARK OFFICE

CERTIFICATE OF CORRECTION

PATENT NO. : 4,578,158

DATED : March 25, 1986

INVENTOR(S) : Tatsuya Kanamaru et al.

It is certified that error appears in the above-identified patent and that said Letters Patent is hereby corrected as shown below:

ABSTRACT, column 2, 5th line from the bottom, change "$n^4 = 2$" to --$n^4 = 3$--.

ABSTRACT, column 2, 3rd line from the bottom, change "$(C_1-C_2)$" to --$(C_1-C_{20})$--.

Column 3, line 39, change "$n^6$ represent" to --$n^6$ represents--.

Column 6, line 10, change "is" to --are--.

Column 8, line 61, change "by weight by zinc" to --by weight of zinc--.

Column 10, Exp. 15, change "Naphthylpolyoxyetylene" to --Naphthylpolyoxyethylene--.

Column 10, Exp. 17, change "naphthylpolyoxylethylene" to --naphthylpolyoylethylene--.

UNITED STATES PATENT AND TRADEMARK OFFICE

CERTIFICATE OF CORRECTION

PATENT NO. : 4,578,158

DATED : March 25, 1986

INVENTOR(S) : Tatsuya Kanamaru et al.

It is certified that error appears in the above-identified patent and that said Letters Patent is hereby corrected as shown below:

Column 9, last lines, omit "Compar-" and "ative".

Column 11, first line, change "Example" to --Comparative Example--.

Column 13, Comp. Exp. 9, move "100 g/l" up to the same line as "Example 9".

Column 15, 4th line, change second number in that column from "28" to --29--.

Column 19, line 27, (Table Footnote), change "naphylpolyoxyethylene" to --naphthylpolyoxyethylene--.

Column 20, line 67, change "represent" to --represents--.

UNITED STATES PATENT AND TRADEMARK OFFICE

CERTIFICATE OF CORRECTION

PATENT NO. : 4,578,158

DATED : March 25, 1986

INVENTOR(S) : Tatsuya Kanamaru et al.

It is certified that error appears in the above-identified patent and that said Letters Patent is hereby corrected as shown below:

Column 21, line 9, change "whereim" to --wherein--.

Signed and Sealed this

Second Day of December, 1986

*Attest:*

DONALD J. QUIGG

*Attesting Officer*

*Commissioner of Patents and Trademarks*